US007428967B2

(12) United States Patent
Petrucci et al.

(10) Patent No.: US 7,428,967 B2
(45) Date of Patent: Sep. 30, 2008

(54) RIGID, HINGED-LID, CLICK-OPEN PACKAGE FOR TOBACCO ARTICLES

(75) Inventors: Luca Petrucci, Castelfranco Emilia (IT); Stefano Negrini, Calderara Di Reno (IT)

(73) Assignee: G.D Societa' Per Azioni, Bologna (IT)

( * ) Notice: Subject to any disclaimer, the term of this patent is extended or adjusted under 35 U.S.C. 154(b) by 473 days.

(21) Appl. No.: 11/079,809

(22) Filed: Mar. 14, 2005

(65) Prior Publication Data

US 2005/0199517 A1 Sep. 15, 2005

(30) Foreign Application Priority Data

Mar. 15, 2004 (IT) ..... BO2004A0152

(51) Int. Cl.
*B65D 85/10* (2006.01)
*A24F 15/00* (2006.01)

(52) U.S. Cl. ..... 206/242; 206/265; 206/268; 206/273; 229/87.13

(58) Field of Classification Search ..... 206/242, 206/264–270, 273; 446/114, 404, 415, 418; 220/836, 839; 229/87.12–87.14, 106.1; 215/230
See application file for complete search history.

(56) References Cited

U.S. PATENT DOCUMENTS

| | | | | | |
|---|---|---|---|---|---|
| 3,165,225 | A * | 1/1965 | Reitzel | 220/324 |
| 3,777,882 | A * | 12/1973 | McIntyre | 206/370 |
| 4,049,117 | A * | 9/1977 | Grimm | 206/270 |
| 4,294,399 | A | 10/1981 | Wilfer | |
| 4,462,504 | A * | 7/1984 | Roth et al. | 220/214 |
| 5,067,615 | A * | 11/1991 | Davitian | 229/230 |
| 5,368,176 | A * | 11/1994 | Thanisch | 215/235 |
| 5,437,383 | A * | 8/1995 | Stull | 215/235 |
| 5,586,648 | A * | 12/1996 | Focke et al. | 206/264 |
| 2003/0116614 | A1 * | 6/2003 | Block et al. | 229/146 |
| 2006/0231518 | A1 * | 10/2006 | Suffa | 215/237 |

FOREIGN PATENT DOCUMENTS

| | | |
|---|---|---|
| DE | 298 14 612 U1 | 8/1998 |
| EP | 0 884 247 A1 | 12/1998 |
| EP | 0 894 737 A1 | 2/1999 |
| FR | 2197774 A1 | 5/1974 |

* cited by examiner

*Primary Examiner*—Jila M. Mohandesi
*Assistant Examiner*—Steven A. Reynolds
(74) *Attorney, Agent, or Firm*—Marshall, Gerstein & Borun LLP

(57) ABSTRACT

A rigid package for tobacco articles, having a cup-shaped container having an open end; and a cup-shaped lid hinged to the container along a hinge to rotate, with respect to the container, between an open position and a closed position respectively opening and closing the open end; a mechanical sound member being provided to generate an audible sound as the lid is opened, and which is located astride the hinge.

23 Claims, 4 Drawing Sheets

RIGID, HINGED-LID, CLICK-OPEN PACKAGE FOR TOBACCO ARTICLES

CROSS-REFERENCE TO RELATED APPLICATION

This application claims the benefit of Italian patent application number BO2004A000152, filed Mar. 15, 2004.

The present invention relates to a rigid, hinged-lid package for tobacco articles.

The present invention may be used to particular advantage in a rigid cigarette packet, to which the following description refers purely by way of example.

BACKGROUND OF THE INVENTION

Rigid, hinge-lid cigarette packets are currently the most widely marketed, by being easy to make, easy and practical to use, and providing good mechanical protection of the cigarettes inside.

A rigid, hinge-lid cigarette packet normally comprises a cup-shaped container having an open end; and a cup-shaped lid hinged to the container along a hinge to rotate, with respect to the container, between an open position and a closed position respectively opening and closing the open end. A collar, folded into a U, is normally fitted inside the container, and projects partly outwards of the open end to engage a corresponding inner surface of the lid when the lid is in the closed position.

To further enhance rigid, hinged-lid cigarette packets, a particular mechanical connection between the collar and the lid has been proposed, whereby a clearly audible sound is produced when the lid is rotated about a hinge line, and in particular is closed by the user.

EP-0884247-A1, for example, describes a rigid, hinged-lid cigarette packet comprising a click-on connection between the front inner wall of the lid and the front outer wall of the collar. More specifically, the click-on connection comprises a tongue projecting from the front outer wall of the collar, and which, when the lid is closed, engages a seat formed in the front inner wall of the lid. When the lid is completely closed, engagement of the collar tongue inside the lid seat produces a clicking sound clearly audible by the user.

In rigid cigarette packets of the type described above, the tongue projecting from the front outer wall of the collar is definitely unsightly, and both the tongue on the collar and the seat on the lid make the packet more difficult and therefore more expensive to produce.

SUMMARY OF THE INVENTION

It is an object of the present invention to provide a rigid package for tobacco articles, which is easier and more practical to use than known packages, has none of the aforementioned drawbacks, and, at the same time, is cheap and easy to produce.

According to the present invention, there is provided a rigid package for tobacco articles as recited in attached claims.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
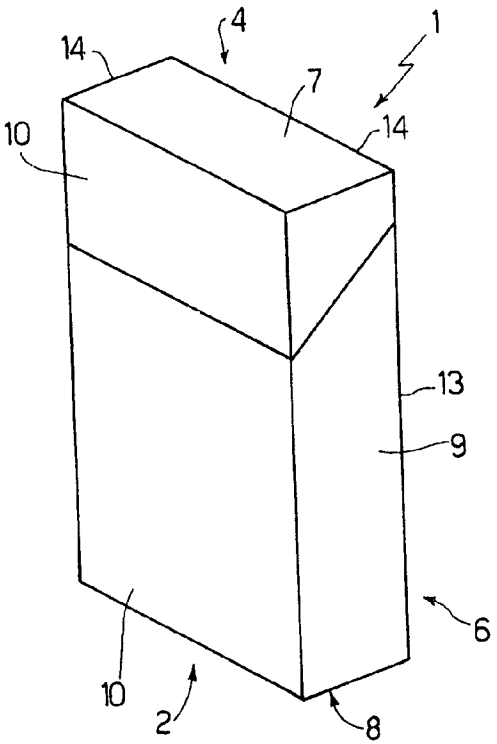
FIG. 1 shows a front view in perspective of a rigid cigarette packet in accordance with the present invention and in a closed configuration.

Number 1 in FIG. 1 indicates as a whole a rigid packet of cigarettes, which normally contains an orderly, parallelepiped-shaped group of cigarettes (not shown for clarity) wrapped in a sheet of foil packing material.

Packet 1 comprises a cup-shaped container 2 having an open top end 3; and a cup-shaped lid 4 hinged to container 2 along a hinge 5 to rotate, with respect to container 2, between an open position (FIG. 2) and a closed position (FIGS. 1 and 3) respectively opening and closing open end 3.

When lid 4 is in the closed position, packet 1 is in the form of a rectangular parallelepiped defined by a lateral surface 6, and by two identical, respectively top and bottom, flat, parallel, facing end walls 7 and 8 bounding lateral surface 6. More specifically, end wall 7 defines a top wall of packet 1, and end wall 8 defines a bottom wall of packet 1.

Lateral surface 6 comprises two parallel, facing, flat minor lateral walls 9; and two, respectively front and rear, flat major lateral walls 10 and 11 facing each other and crosswise to minor lateral walls 9. More specifically, major lateral wall 10 defines a front wall of packet 1, and major lateral wall 11 defines a rear wall of packet 1.

Figure 3:
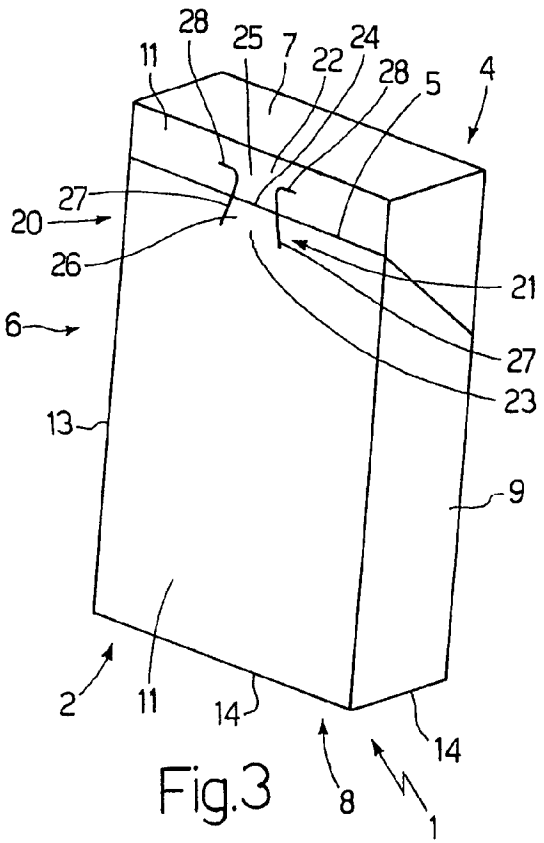
FIG. 3 shows a rear view of the FIG. 1 rigid cigarette packet in a closed configuration.

Packet 1 also comprises a collar 12, which is folded into a U and fitted (glued) inside container 2 to project partly outwards of open end 3 and engage a corresponding inner surface of lid 4 when lid 4 is in the closed position (FIGS. 1 and 3).

Four longitudinal edges 13 are defined between minor lateral walls 9 and major lateral walls 10 and 11, and eight transverse edges 14 are defined between end walls 7 and 8 and lateral walls 9, 10 and 11. As shown in the accompanying drawings, longitudinal edges 13 and transverse edges 14 are all sharp, square edges.

Figure 2:
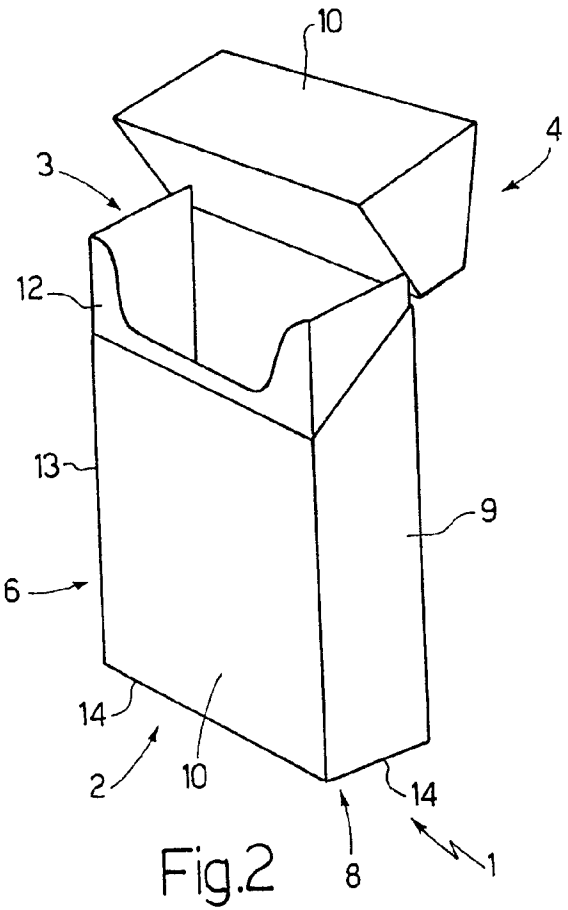
FIG. 2 shows a front view in perspective of the FIG. 1 rigid cigarette packet in an open configuration.
Figure 4:
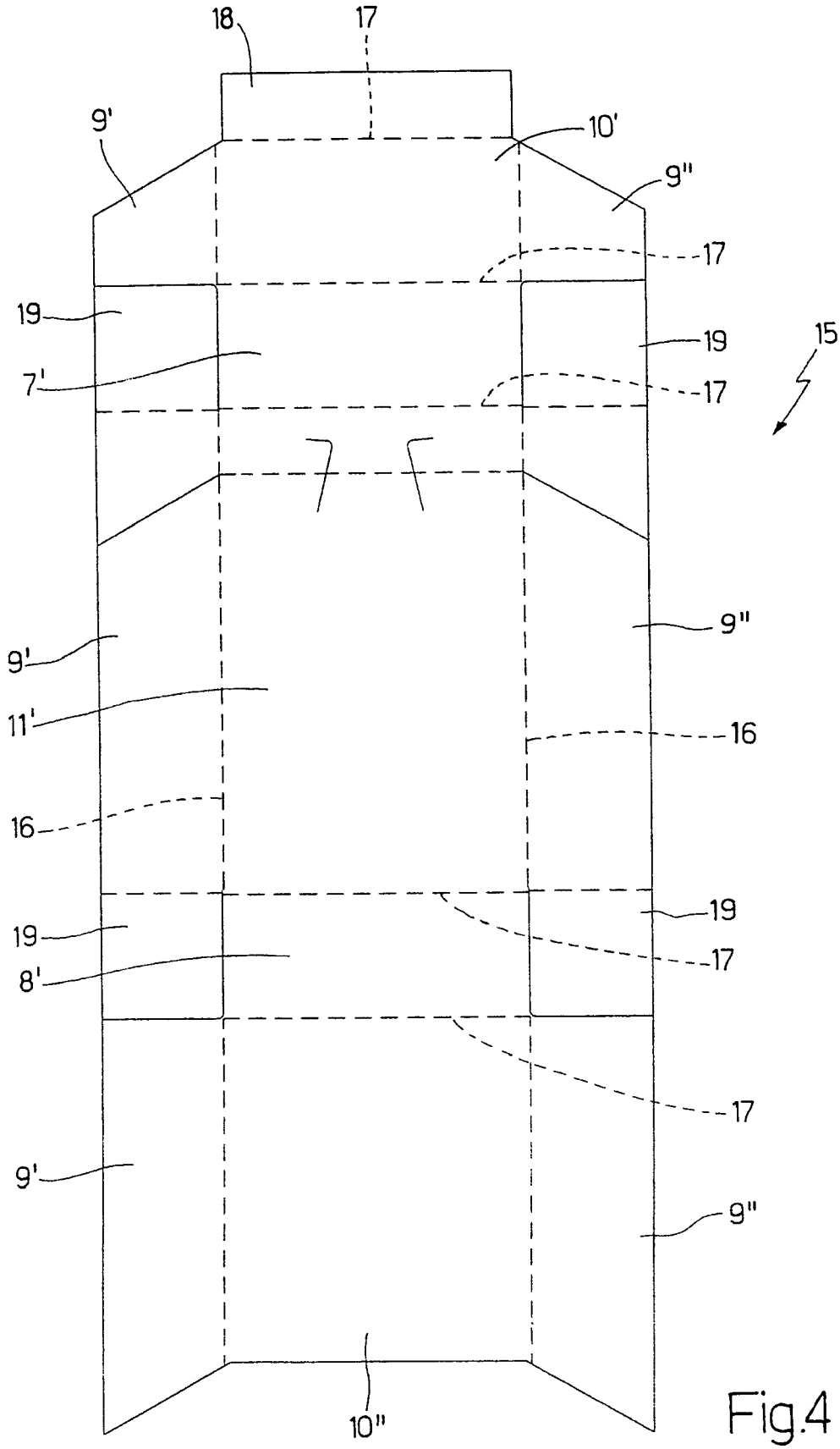
FIG. 4 shows a plan view of a blank by which to produce the rigid cigarette packet in FIGS. 1-3.

As shown in FIG. 4, packet 1 in FIGS. 1-3 is formed from a flat blank 15 substantially in the form of an elongated rectangle, and the component parts of which are indicated, where possible, using the same reference numbers, with superscripts, as for the corresponding parts of packet 1.

Blank 15 comprises two longitudinal fold lines 16; and a number of transverse fold lines 17 defining, between the two longitudinal fold lines 16, a panel 10' defining a top portion of front wall 10 (in particular, the lid 4 portion); a panel 7' defining top end wall 7; a panel 11' defining rear wall 11; a panel 8' defining bottom end wall 8; and a panel 10" defining a bottom portion of front wall 10 (in particular, the container 2 portion).

Each panel 10', 10", 11' has two lateral wings 9' and 9" located on opposite sides of panel 10', 10", 11' and separated from panel 10', 10", 11' by longitudinal fold lines 17. Panel 10' has a reinforcing flap 18, and each wing 9', 9" of panel 11' has two rectangular longitudinal appendixes 19 aligned longitudinally with each other and located at opposite ends of wing 9', 9".

When forming packet 1, each lateral wing 9', 9" is superimposed on and glued to the corresponding lateral wing 9', 9"

to define a respective portion of a minor lateral wall 9 of packet 1; and each longitudinal appendix 19 is folded squarely with respect to the relative lateral wing 9', 9", and is superimposed on and glued to an inner surface of a corresponding panel 7', 8' to define an inner portion of a relative end wall 7, 8 of packet 1.

As shown in FIG. 3, packet 1 comprises a mechanical sound member 20 positioned astride hinge 5 and which generates an audible sound as lid 4 is rotated about hinge 5.

More specifically, sound member 20 comprises a bistable member 21 positioned astride hinge 5 and which acts by contrast between rear wall 11 of lid 4 and rear wall 11 of container 2. As shown clearly in FIG. 3, rear wall 11 of lid 4 is separated from rear wall 11 of container 2 by hinge 5.

Figure 5:
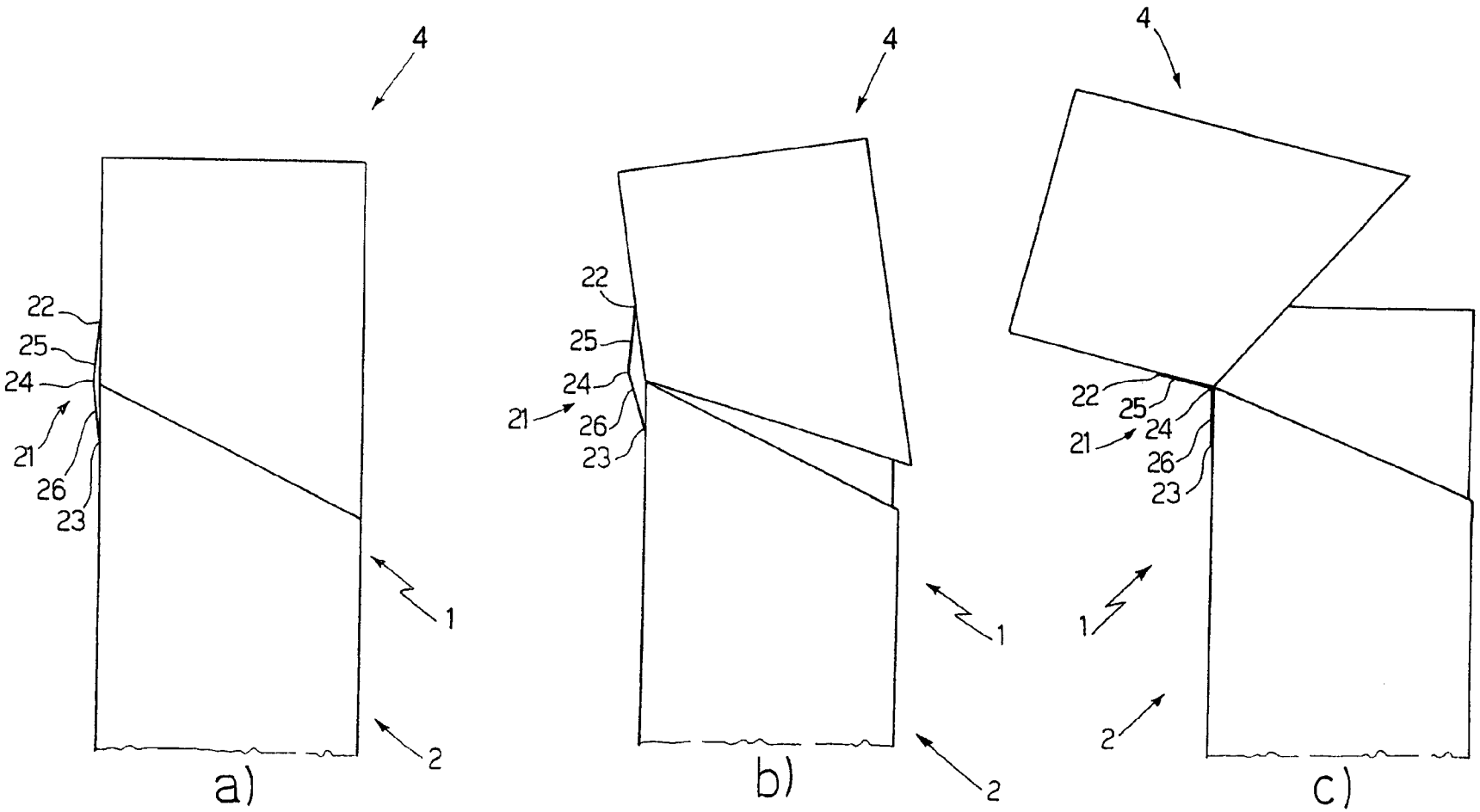
FIG. 5 shows a succession of larger-scale side views of part of the rigid cigarette packet in FIGS. 1-3 as the lid is opened.

As shown in FIG. 5, bistable member 21 may assume a first configuration (FIGS. 5*a* and 5*b*) in which bistable member 21 is raised off walls 11 of container 2 and lid 4, and a second configuration (FIG. 5*c*) in which bistable member 21 is aligned with walls 11 of container 2 and lid 4.

Bistable member 21 assumes the first configuration when lid 4 is in the closed position closing open end 3, and assumes the second configuration when lid 4 is in the open position opening open end 3. Passage from the first to the second configuration takes place automatically when opening lid 4, and passage from the second to the first configuration takes place automatically when closing lid 4. An audible sound is only produced when bistable member 21 passes from the first to the second configuration, when opening lid 4, and as a result of bistable member 21 striking walls 11 of container 2 and lid 4.

In the FIG. 3 embodiment, bistable member 21 is defined by a strip having an end 22 on lid 4, and an end 23 on container 2. More specifically, end 22 of bistable member 21 is integral with lid 4, and end 23 of bistable member 21 is integral with container 2.

Bistable member 21 has a bend line 24, which divides bistable member 21 into two connected portions 25 and 26. More specifically, portion 25 of bistable member 21 is a top portion and comprises end 22 integral with lid 4, and portion 26 of bistable member 21 is a bottom portion and comprises end 23 integral with container 2.

When bistable member 21 is in the first configuration, and lid 4 is opened as of the closed position closing open end 3, top portion 25 of bistable member 21 subjects bottom portion 26 of bistable member 21 to combined bending and compressive stress, so that bottom portion 26 is first pushed away from and then pushed towards walls 11 of container 2 and lid 4.

In the FIG. 3 embodiment, bend line 24 of bistable member 21 is straight, is located in an intermediate position between the two ends 22, 23 of bistable member 21, and is parallel to and substantially superimposed on hinge 5 of lid 4.

Figure 6:
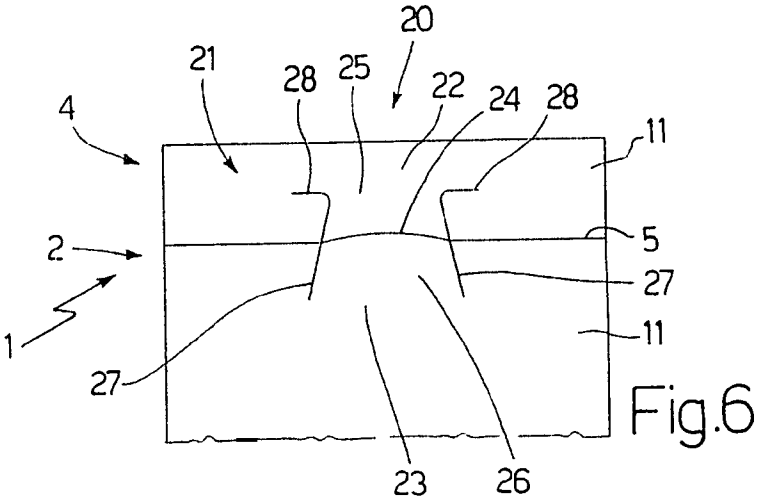
FIGS. 6-9 show partial rear views of further embodiments of a rigid cigarette packet in accordance with the present invention.

In the FIG. 6 embodiment, bend line 24 of bistable member 21 is curved and substantially superimposed on hinge 5 of lid 4.

Figure 7:
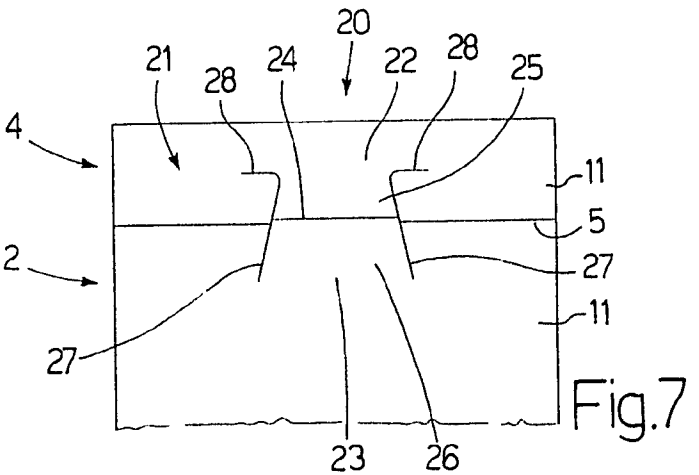

In the FIG. 7 embodiment, bend line 24 of bistable member 21 is straight, and is parallel to and offset with respect to hinge 5 of lid 4.

In the FIG. 3 embodiment, bistable member 21 is in the form of an isosceles trapezium, the minor base of which is parallel to hinge 5 of lid 4 and located at end 22 integral with lid 4, and the major base of which is parallel to hinge 5 of lid 4 and located at end 23 integral with container 2. Bistable member 21 is separated from walls 11 of container 2 and lid 4 by two inclined slits 27 converging with each other and crosswise to hinge 5 of lid 4. On lid 4, each slit 27 has an appendix 28 substantially parallel to hinge 5 of lid 4 and extending from slit 27 in the opposite direction to the other slit 27.

Figure 8:
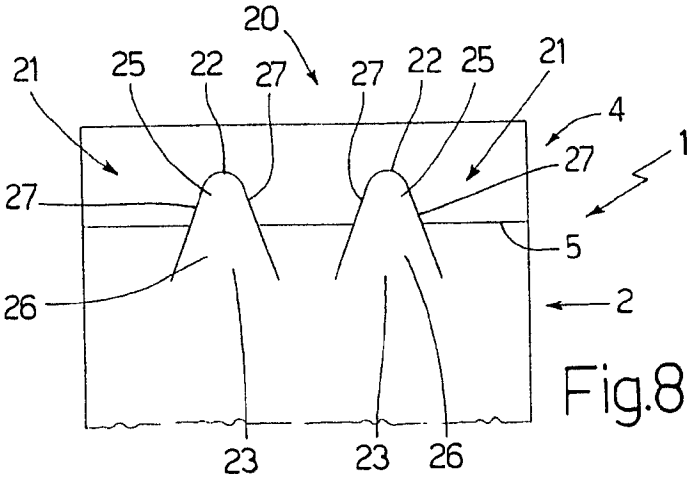

In the FIG. 8 embodiment, bistable member 21 comprises two strips, each of which has end 22 resting on and physically separate from lid 4, while the other end 23 is integral with container 2. In this embodiment, each strip is in the form of an isosceles triangle, the tip of which is located at end 22, and the base of which is parallel to hinge 5 of lid 4 and located at end 23 integral with container 2 (the tip of the isosceles triangle is preferably rounded).

Figure 9:
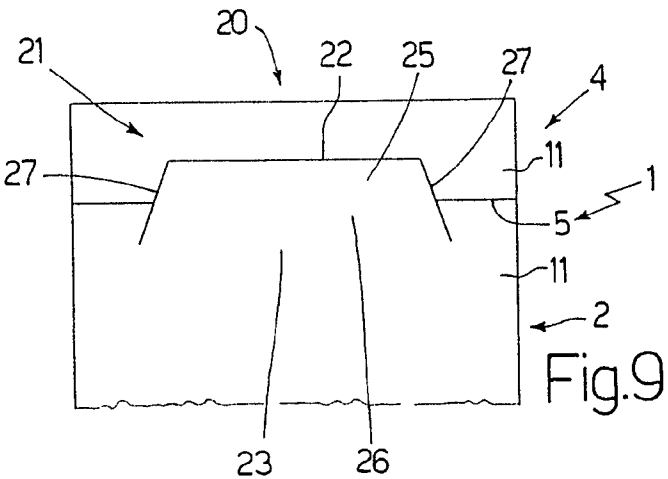

In the FIG. 9 embodiment, end 22 of bistable member 21 rests on and is physically separate from lid 4, while end 23 of bistable member 21 is integral with container 2. In this embodiment, bistable member 21 is in the form of an isosceles trapezium, the minor base of which is parallel to hinge 5 of lid 4 and located at end 22 resting on lid 4, and the major base of which is parallel to hinge 5 of lid 4 and located at end 23 integral with container 2.

When producing packet 1 or blank 15, bistable member 21 is preferably deformed slightly into the first configuration described above, in which bistable member 21 is raised off walls 11 of container 2 and lid 4. In other words, in the absence of external intervention, when packet 1 is completed, bistable member 21 assumes the second configuration described above, in which bistable member 21 is aligned with walls 11 of container 2 and lid 4, and, when packet 1 is opened for the first time, bistable member 21 assumes the first configuration for the first time. By slightly deforming bistable member 21 when producing packet 1 or blank 15, bistable member 21 is already in the first configuration when packet 1 is completed.

In the embodiments shown in the accompanying drawings, longitudinal edges 13 and transverse edges 14 are all square, sharp edges. In an alternative embodiment not shown, some longitudinal edges 13 and/or some transverse edges 14 are non-square, rounded or bevelled edges. For example, longitudinal edges 13 may all be non-square, rounded or bevelled edges, or (as in the packet of cigarettes described in Patent Application EP-A1-0764595), major transverse edges 14 (i.e. defined between end walls 7 and 8 and major lateral walls 10 and 11) may all be non-square, rounded or bevelled edges. Alternatively, some longitudinal edges 13 and some transverse edges 14 may be non-square, rounded or bevelled edges, so as to have non-square, rounded or bevelled longitudinal edges 13 and transverse edges 14.

In a different embodiment not shown, packet 1 may resemble the packet of cigarettes described in Patent Application EP-A1-1066205; in which case, each major lateral wall 10 and 11 is outwardly convex, and comprises a flat central portion, and two curved lateral fold strips connecting the flat central portion to minor lateral walls 9 along respective sharp, non-square longitudinal edges 13.

In another embodiment not shown, packet 1 may resemble the packet of cigarettes described in Patent Application IT-BO2001A000584; in which case, each major lateral wall 10 and 11 is outwardly convex, and comprises a flat central portion, and two curved lateral fold strips connecting the flat central portion to end walls 7 and 8 along respective sharp, non-square transverse edges 14.

In the embodiments shown in the accompanying drawings, hinge 5 of lid 4 is parallel to transverse edges 14 defined between end walls 7 and 8 and major lateral walls 10 and 11, and is located on rear major lateral wall 11. In further embodiments not shown, hinge 5 of lid 4 may be parallel to transverse edges 14 defined between end walls 7 and 8 and minor lateral walls 9, and may be located on a minor lateral wall 9 or on top end wall 8.

In a different embodiment not shown, container 2 and lid 4 have respective facing edges, which are spaced apart when lid 4 is in the closed position, and which may or may not be parallel, and may be straight or curved.

Packet 1 as described above has various advantages, by being fast and easy to produce, and by involving no additional folding as compared with a standard rigid, hinged-lid packet. More specifically, the only alteration, with respect to a standard rigid, hinged-lid packet, is the formation of slits 27 defining bistable member 21. Moreover, packet 1 as described above produces a sound, clearly audible by the user, whenever lid 4 is opened.

Given the numerous advantages of packet 1 as described above, the form of packet 1 may also be applied integrally to the manufacture of other types of rigid containers for tobacco articles, such as cartons of packets of cigarettes, or cigar packets.

The invention claimed is:

1. A rigid package for tobacco articles, comprising a cup-shaped container (2) having an open end (3);

a cup-shaped lid (4) hinged to the container (2) along a hinge (5) located between a rear wall (11) of the lid (4) and a rear wall (11) of the container (2) to rotate, with respect to the container (2), between an open position and a closed position respectively opening and closing the open end (3); and mechanical sound means (20), which generate an audible sound as the lid (4) is rotated about the hinge (5), are located astride and over the hinge (5), and have a first end (22) at the rear wall (11) of the lid (4) and a second end (23) at the rear wall (11) of the container (2) to be operated by the rotational movement between the rear wall (11) of the lid (4) and the rear wall (11) of the container (2);

wherein the mechanical sound means (20) comprise a bistable member (21) located astride the hinge (5), and which acts by contrast between the rear wall (11) of the lid (4) and the rear wall (11) of the container (2); and wherein the bistable member (21) may assume a first configuration, in which the bistable member (21) is raised off the rear walls (11) of the container (2) and the lid (4), and a second configuration, in which the bistable member (21) is substantially aligned with the rear walls (11) of the container (2) and the lid (4).

2. A package as claimed in claim 1, wherein the first configuration is assumed when the lid (4) is in said closed position closing the open end (3), and the second configuration is assumed when the lid (4) is in said open position opening the open end (3); passage from the first configuration to the second configuration taking place automatically when opening the lid (4); and passage from the second configuration to the first configuration taking place automatically when closing the lid (4).

3. A package as claimed in claim 2, wherein an audible sound is only produced when the bistable member (21) passes from the first configuration to the second configuration, when opening the lid (4), and as a result of the bistable member (21) striking the rear walls (11) of the container (2) and the lid (4).

4. A package as claimed in claim 3, wherein the bistable member (21) is defined by at least one strip having a first end (22) at the lid (4), and a second end (23) at the container (2); the bistable member (21) assuming a first configuration, in which the bistable member (21) is raised off the rear walls (11) of the container (2) and the lid (4), and a second configuration, in which the bistable member (21) is substantially aligned with the rear walls (11) of the container (2) and the lid (4).

5. A package as claimed in claim 4, wherein the bistable member (21) comprises a number of parallel, side by side strips, each of which has a first end (22) at the lid (4), and a second end (23) at the container (2).

6. A package as claimed in claim 4, wherein the first end (22) of the bistable member (21) is integral with the lid (4), and the second end (23) of the bistable member (21) is integral with the container (2).

7. A package as claimed in claim 6, wherein the bistable member (21) comprises a bend line (24) dividing the bistable member (21) into two connected portions; a first portion (25) of the bistable member (21) having the first end (22) integral with the lid (4); and a second portion (26) of the bistable member (21) having the second end (23) integral with the container (2).

8. A package as claimed in claim 7, wherein the bend line (24) of the bistable member (21) is located in an intermediate position between the two ends (22, 23), and is parallel to and substantially superimposed with respect to the hinge (5) of the lid (4).

9. A package as claimed in claim 7, wherein the bend line (24) of the bistable member (21) is located in an intermediate position between the two ends (22, 23), and is parallel to and offset with respect to the hinge (5) of the lid (4).

10. A package as claimed in claim 7, wherein the bend line (24) of the bistable member (21) is straight.

11. A package as claimed in claim 7, wherein the bend line (24) of the bistable member (21) is curved.

12. A package as claimed in claim 7, wherein, when the bistable member (21) is in the first configuration and the lid (4) is opened as of said closed position closing the open end (3), the first portion (25) of the bistable member (21) subjects the second portion (26) of the bistable member (21) to combined bending and compressive stress, so that the second portion (26) is first pushed away from the rear walls (11) of the container (2) and the lid (4), and then towards the rear walls (11) of the container (2) and the lid (4).

13. A package as claimed in claim 6, wherein the strip is in the form of an isosceles trapezium, the minor base of which is parallel to the hinge (5) of the lid (4) and located at the first end (22) integral with the lid (4), and the major base of which is parallel to the hinge (5) of the lid (4) and located at the second end (23) integral with the container (2).

14. A package as claimed in claim 13, wherein the strip is separated from the rear walls (11) of the container (2) and the lid (4) by two inclined slits (27) converging with each other and extending crosswise with respect to the hinge (5) of the lid (4); on the lid (4), each slit (27) having an appendix (28), which is substantially parallel to the hinge (5) of the lid (4) and extends from the slit (27) in the opposite direction to the other slit (27).

15. A package as claimed in claim 4, wherein the first end (22) of the bistable member (21) rests on the lid (4) and is physically separate from the lid (4); the second end (23) of the bistable member (21) being integral with the container (2).

16. A package as claimed in claim 15, wherein the strip is in the form of an isosceles trapezium, the minor base of which is parallel to the hinge (5) of the lid (4) and located at the first end (22), and the major base of which is parallel to the hinge (5) of the lid (4) and located at the second end (23) integral with the container (2).

17. A package as claimed in claim 15, wherein the strip is in the form of an isosceles triangle, the tip of which is located at the first end (22), and the base of which is parallel to the hinge (5) of the lid (4) and located at the second end (23) integral with the container (2).

18. A package as claimed in claim 17, wherein the tip of the isosceles triangle is rounded.

19. A package as claimed in claim 1, wherein, when producing the package (1), the bistable member (21) is deformed, so that the bistable member (21) assumes said first configuration.

20. A package as claimed in claim 1, wherein the package (1) is formed from a flat blank (15); when producing the blank (15), the bistable member (21) being deformed, so that the bistable member (21) assumes said first configuration.

21. A package as claimed in claim 1, wherein the rigid package (1) is substantially parallelepiped-shaped, and comprises two, respectively top and bottom, end walls (7, 8), and a lateral surface (6) bounded by the end walls (7, 8); the lateral surface (6) comprising two, respectively front and rear, major lateral walls (10, 11), and two minor lateral walls (9); four longitudinal edges (13) being defined between the major lateral walls (10; 11) and the minor lateral walls (9); eight transverse edges (14) being defined between the end walls (7; 8) and the lateral walls (9; 10; 11); and the hinge (5) of the lid (4) being located on the rear major lateral wall (11), and being parallel to the transverse edges (14) defined between the major lateral walls (10, 11) and the end walls (7, 8).

22. A package as claimed in claim 21, wherein the package (1) is formed from a flat blank (15) having two longitudinal fold lines (16), and a number of transverse fold lines (17) defining, between the longitudinal fold lines (16), a first panel (10') defining part of the front major lateral wall (10), a second panel (7') defining the top end wall (7), a third panel (11") defining the rear major lateral wall (11), a fourth panel (8') defining the bottom end wall (8), and a fifth panel (10") defining the rest of the front major lateral wall (10); the first panel (10'), the third panel (11"), and the fifth panel (10") each having two wings (9', 9") defining part of the minor lateral walls (9); and the wings (9', 9") of the third panel (11') each having two tabs (19).

23. A rigid package for tobacco articles, comprising a cup-shaped container (2) having an open end (3);

a cup-shaped lid (4) hinged to the container (2) along a hinge (5) located between a rear wall (11) of the lid (4) and a rear wall (11) of the container (2) to rotate, with respect to the container (2), between an open position and a closed position respectively opening and closing the open end (3); and mechanical sound means (20), which generate an audible sound as the lid (4) is rotated about the hinge (5), are located astride and over the hinge (5), and have a first end (22) at the rear wall (11) of the lid (4) and a second end (23) at the rear wall (11) of the container (2) to be operated by the rotational movement between the rear wall (11) of the lid (4) and the rear wall (11) of the container (2), wherein the rigid package (1) is substantially parallelepiped-shaped, and comprises two, respectively top and bottom, end walls (7, 8), and a lateral surface (6) bounded by the end walls (7, 8); the lateral surface (6) comprising two, respectively front and rear, major lateral walls (10, 11), and two minor lateral walls (9); four longitudinal edges (13) being defined between the major lateral walls (10; 11) and the minor lateral walls (9); eight transverse edges (14) being defined between the end walls (7; 8) and the lateral walls (9; 10; 11); and the hinge (5) of the lid (4) being located on the rear major lateral wall (11), and being parallel to the transverse edges (14) defined between the major lateral walls (10, 11) and the end walls (7, 8), and wherein the package (1) is formed from a flat blank (15) having two longitudinal fold lines (16), and a number of transverse fold lines (17) defining, between the longitudinal fold lines (16), a first panel (10') defining part of the front major lateral wall (10), a second panel (7') defining the top end wall (7), a third panel (11") defining the rear major lateral wall (11), a fourth panel (8') defining the bottom end wall (8), and a fifth panel (10") defining the rest of the front major lateral wall (10); the first panel (10'), the third panel (11'), and the fifth panel (10") each having two wings (9', 9") defining part of the minor lateral walls (9); and the wings (9', 9") of the third panel (11') each having two tabs (19).

* * * * *